United States Patent [19]

Leinberry

[11] 4,285,074

[45] Aug. 25, 1981

[54] REFILLABLE DISPENSING APPARATUS

[75] Inventor: W. Stanley Leinberry, Studio City, Calif.

[73] Assignee: Enjoyable Products, Inc., Los Angeles, Calif.

[21] Appl. No.: 105,544

[22] Filed: Dec. 20, 1979

[51] Int. Cl.[3] ..... E03D 9/03; G01F 11/32

[52] U.S. Cl. ..... 4/227; 4/228; 222/181; 222/453; 222/482; 215/2; 248/360

[58] Field of Search ..... 222/181, 453, 482; 4/222, 223, 227, 228, 231; 215/2; 248/359, 360, 339

[56] References Cited

U.S. PATENT DOCUMENTS

| | | | |
|---|---|---|---|
| 2,320,128 | 5/1943 | Hall | 4/227 |
| 2,581,897 | 1/1952 | Allen | 222/453 UX |
| 2,722,394 | 11/1955 | Titmas | 4/227 X |
| 2,726,406 | 12/1955 | Vierra | 4/228 |
| 3,258,178 | 6/1966 | Gran | 222/482 |
| 3,515,312 | 6/1970 | Heier | 222/453 X |
| 3,841,524 | 10/1974 | Easter | 4/227 X |
| 3,865,277 | 2/1975 | Rimini | 222/453 X |
| 4,101,043 | 7/1978 | Johnson et al. | 248/359 X |

FOREIGN PATENT DOCUMENTS

| | | | |
|---|---|---|---|
| 1278126 | 10/1961 | France | 4/227 |

*Primary Examiner*—Robert J. Spar
*Assistant Examiner*—Frederick R. Handren
*Attorney, Agent, or Firm*—Robert R. Thornton

[57] ABSTRACT

A refillable bottle for use in dispensing cleaning liquid into a toilet tank has openings at both ends, the bottle being installed in the tank by an integral hanger so that one opening, which is always above tank water level, is used for refilling the bottle in place in the tank with cleaning liquid and, being open after bottle installation, allows aerosols in the cleaning liquid to diffuse into the tank air so as to be forced from the tank by rising water in the tank to freshen the surroundings. The other opening has a dispensing valve mechanism mounted therein. Removable caps close the openings prior to installation. A float attached to a movable member of the valve mechanism actuates the mechanism so as to dispense a constant quantity of bottle liquid upon toilet flushing regardless of liquid level in the bottle or the refilling speed of the tank. The movable member has two oppositely disposed valve heads which mate with fixed valve seats formed in the valve mechanism.

7 Claims, 4 Drawing Figures

REFILLABLE DISPENSING APPARATUS

BACKGROUND AND SUMMARY OF THE INVENTION

This invention relates to a fluid dispensing apparatus which is particularly useful as an automatic method of cleaning and deodorizng flush toilet bowls and performing other related functions, although it can be used in other applications where the conditions necessary for proper function are present.

A number of manufacturers presently market single-use, throw-away toilet bowl cleansing and deodorizing liquid dispensers. These devices take the form of a single-necked bottle. A dispensing device is fitted to the neck. The bottle is filled with liquid cleansing and deodorizing concentrate. A hanger is attached at or near the opposite, closed end of the bottle so that, once the bottle cap has been removed, the bottle may be inverted and hung in a flush toilet water tank. Thereafter, the dispensing device delivers a more or less predetermined amount of the concentrate to the toilet tank water, in response to the rise and fall of tank water, as occurs in flushing. The concentrate then mixes with tank water, is diluted and subsequently is carried to the toilet bowl where its ingredients clean and deodorize the bowl.

Because of the considerable dilution which occurs to the concentrate in mixing with tank water and the fact that all but a small percentage of tank water flushes through the bowl and down the drain, the amount of concentrate remaining in the bowl to perform the deodorization function is often marginal or of insignificant value. Further, while some bottle designs allow refilling by partial disassembly of their dispensing device, others are refillable only by complete disassembly, and all are intended as single-use, throw-away units. On those bottles which may be refilled by partial disassembly of their dispensers, the process requires careful removal of the bottle from the toilet tank, then partial disassembly, refilling, reassembly and rehanging in the toilet tank. Such a process may be messy in that the dye concentrate commonly used in such devices will easily stain fingers, surrounding woodwork, carpeting and the like if extreme care if not exercised during the entire process.

Moreover, presently used devices of this nature treat only toilet tank water, none treat toilet tank air.

Concentrate-containing dispensing bottles presently marketed are all closed-ended and their dispensing devices rely on the development of a partial vacuum in that void present in the inverted bottle above the fluid concentrate. This vacuum greatly subtracts from the bottle fluid head pressure on the dispensing device, a number of such devices presently using a simple water trap to stop flow and dispense fluid. If the vacuum on which a water trap depends is destroyed, the trap's ability to stop flow or dispense a predetermined amount of concentrate is rendered inoperative.

Other bottles of this type use a valving device to accomplish the dispensing function but, because such valves must accommodate little or no fluid pressure head for their intended purpose in a closed-ended bottle, their design is such that when the vacuum is removed by opening the end of the bottle, they malfunction and allow an uncontrolled flow of bottle fluid to the tank water.

It is a purpose of my invention to provide a unique dispensing apparatus which may be easily hung using its special-purpose hanging device within a flush toilet tank after its dispensing valve cap has been removed and the bottle has been inverted. Once hung, a second cap at or near the upper end of the bottle is removed so that the concentrate in the bottle has free access to toilet tank air.

This second bottle opening serves at least three purposes. By communicating to tank air, it allows air freshening aerosols in the concentrate to mix with the air entering the tank, said air thereafter being expelled from the tank top by the tank water fill cycle to freshen the entire bathroom. Second, this bottle opening, which may be recessed well below the top of the toilet tank, facilitates bottle refilling, eliminating the problems attendant with previously used refill methods. Third, it allows easy ascertainment of fluid level within the bottle so that the user is able to tell if the bottle requires refilling.

Another purpose of my invention is to provide a unique dispensing valve which will accommodate open-ended bottle full fluid head pressure and will dispense a predetermined amount of the concentrate to the toilet tank water. As will be seen, special features of my dispenser make the amount of fluid dispensed constant and independent of fluid head in the bottle, be it nearly full or nearly empty.

Yet another unique feature of my invention provides the consumer an unlimited choice in the scent desired to affect its bathroom air freshening feature. Many standard scents may be marketed, premixed with the other ingredients. As another option, an unscented variety may be purchased, my special bottle allowing sufficient internal volume to permit the addition of the user's favorite cologne or other aerosol to the bottle fluid. Of course, for those not desiring the scented air freshening characteristic, an unscented variety may be used alone or be used with an odorless air freshener.

BRIEF DESCRIPTION OF THE DRAWING

My invention may be more readily understood by referring to the accompanying drawing in which.

DESCRIPTION OF THE PREFERRED EMBODIMENTS

Figure 1:
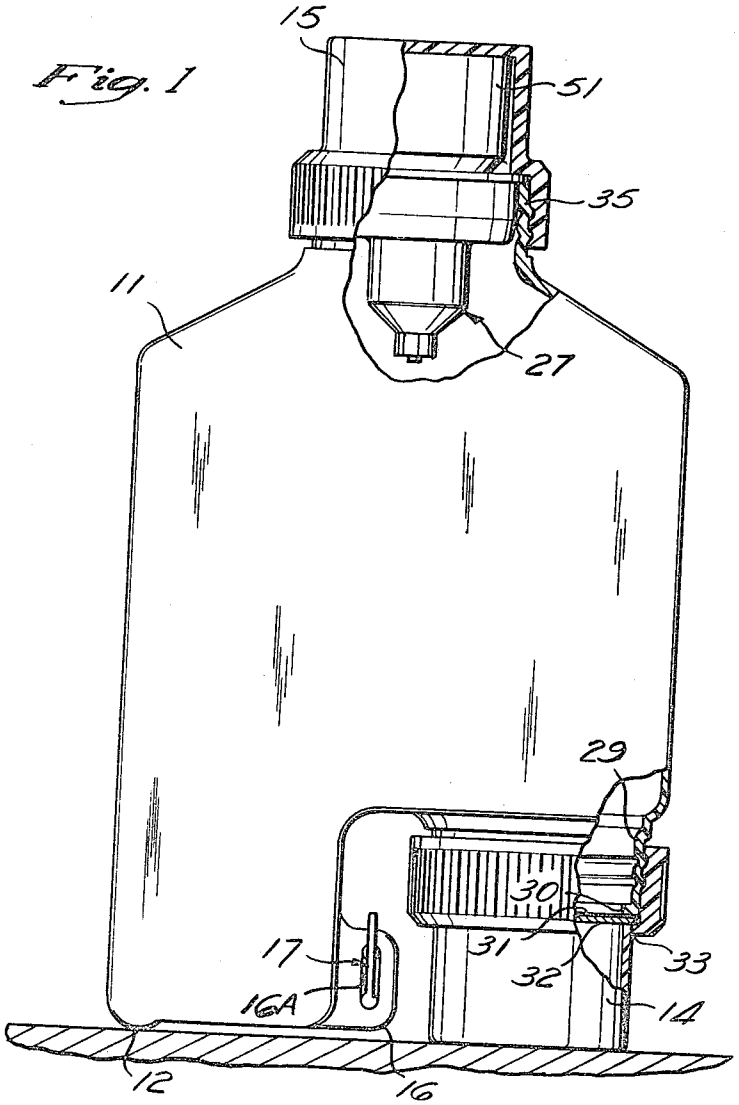
FIG. 1 is a side elevation, partially broken away, of a bottle, including a dispenser, according to my invention.

Referring now to FIG. 1, there is shown bottle 11 which may be conveniently made of plastic or of any other material possessing the proper physical properties. A lobe 12 at one end of the bottle 11 and a refill cap 14 provide the stability necessary on a shelf, shown in section, to maintain the bottle standing solidly upright as shown in FIG. 1. A dispenser cap 15 is located at the opposite end of the bottle 11 from the cap 14. The refill cap 14 may have the same dimensions as the dispenser cap 15.

Figure 2:
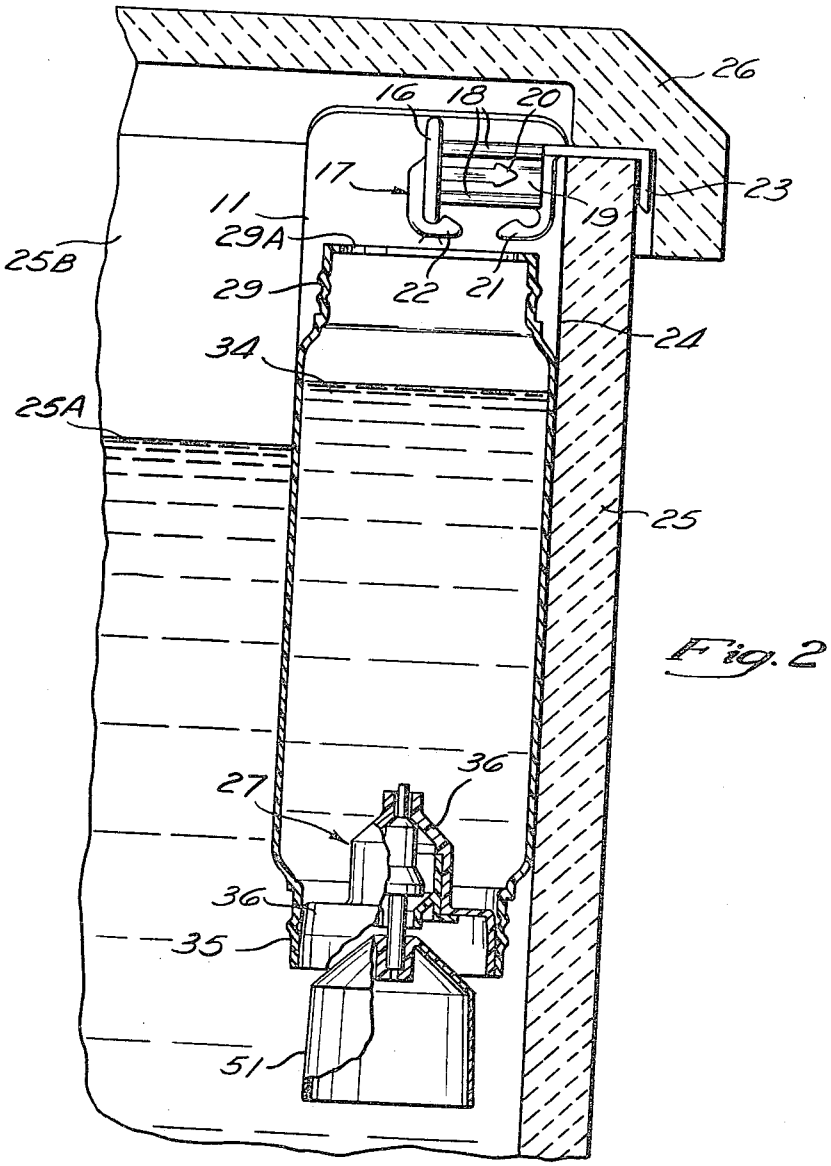
FIG. 2 is a partial sectional view of the bottle and dispenser of FIG. 1 installed in a toilet tank.

The bottle 11 is provided with a protruding ear 16 containing a slot 16A holding a clip slide 17 (see FIG. 2). The clip slide 17 has rounded guidance lobes 18 engaging the top and bottom of the ear 16 slot 16A. The central flat portion 19 of the clip slide 17 has the profile of an arrow 20 to show the direction of slide movement necessary to extend the clip to hang the bottle. The lower ends of the clip slide 17 have first and second flexible L-shaped locking lugs 21, 22. First lug 21 engages the snaps around the lower portion of the slotted ear 16 to maintain the hanging device retracted for shipment purposes. To hang the bottle, the clip slide 17 is moved in the direction of its arrow 20, unsnapping its locking lug 21. The second locking lug 22 then is snapped around the bottle ear 16. In this latter position, a hanger portion 23 of the clip slide 17 extends beyond an outer bottle sidewall 24 which abuts against a toilet tank 25, which is covered by a tank lid 26.

As is seen in FIG. 1, the bottle has a dispensing valve 27 which is disposed within the cap 15. The cap 14 closes a threaded hollow refill bottleneck 29, so as to seal the opening in the bottle formed thereby. The bottleneck has a small inwardly flanged portion 30 whose purpose is to receive and be positively sealed by a conventional foil seal 31, using ultrasonic or other appropriate sealing techniques. This foil seal is backed up by a supporting bulkhead 32 of a sufficient rigidity such that, when clamped by the cap 14 to the bottleneck flange 30, the bulkhead 32 maintains the foil seal 31 intact and leaktight during subsequent handling. The bulkhead 32 fits a cylindrical interface 33 formed in the cap 14 and will separate from the foil seal 31 and remain within the cap 14 when the cap is removed from the bottleneck 29, leaving the foil seal 31 behind on said bottleneck.

FIG. 2 shows the bottle 11 hanging within the toilet tank 25, ready for use, with both caps 14, 15 removed and its dispensing valve 27 in the normal position for tank water 25A at or near its highest level. The ELL-shaped hanger 23 fits over the top of the toilet tank 25 and extends down said tank's outer side. With the toilet tank lid 26 in place, the bottom of the lid and the top of the tank 25 clamp the flat hanger 23 to the toilet tank to minimize bottle motion during flushing cycles.

To ready the bottle for initial operation, the caps 14, 15 and bulkhead 32 are removed and the foil seal 31 is pierced with a sharp instrument and removed, opening the bottleneck 29 to tank air 25B. The bottleneck 29 is well-recessed below the top of the tank 25 so as to prevent inadvertent spilling during subsequent bottle refilling or when adding an aerosol scent. The bottleneck 29 must open to tank air 25B above the highest level attained by tank water 25A to prevent the water from entering the bottle and diluting its concentrate 34. In operation, this bottleneck 29 serves to permit air freshening concentrated aerosols which may be ingredients of the bottle fluid 34 to mix with the toilet tank air. On a flush cycle, water level within the toilet tank drops rapidly, the tank air volume within the tank thereby increasing rapidly. Thus bathroom air is drawn into the tank by passing across the clearance already provided by tank design between the tank 25 and the lid 26. As the bottleneck 29 has an opening 29A located immediately adjacent to this flowpath of inrushing air, the aerosol contents of the bottle are afforded maximum air turbulence to be entrained by and mix with inrushing air. When the toilet tank flushing cycle reverses and the tank refills with water, the scented air is forced out of the toilet tank by the rising water and provides automatic bathroom freshening at precisely the correct time to be most beneficial.

Figure 3:
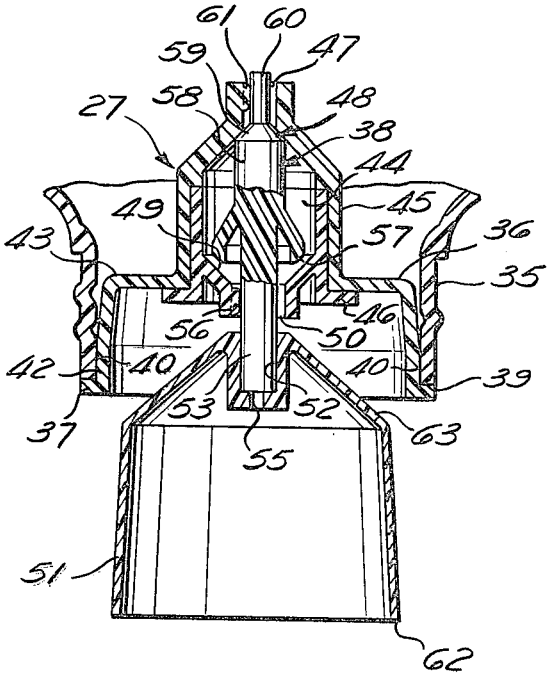
FIG. 3 is a sectional view of the dispenser of FIG. 1.

The dispensing valve assembly 27 is contained in a bottleneck 35. The dispensing valve assembly 27 consists of a stationary member 36 which tightly fits within bottleneck 35 so as to be sealed thereto. FIG. 3 is an enlarged view of the dispensing device 27 shown in cross-section. The stationary member 36, at its lowermost outer periphery in FIG. 3 has an outwardly extending flange 37, which may possess concentric serrations on its upper and lower faces so as to seal against rim 39 on the bottleneck 35 as well as the Cap 15 (See FIG. 1). The dispensing valve assembly 27 also has a movable member or stem 38, which performs the dispensing function. Immediately above said flange 37, the bottleneck 35 contains a short unthreaded cylindrical portion 40 whose outside and inside diameters are free of any thread spiral. The purpose of this cylindrical portion 40 of the bottle, which may be made of relatively flexible plastic material, is to be engaged and supported on its outside diameter by the cap 15, which may be made of relatively rigid plastic. Thus, the bottleneck's cylindrical portion 40 is made sufficiently rigid by the cap to receive a closely-fitting cylindrical portion 42 of the dispensing valve's stationary member 36 in sealing relationship at the inner diameter of the cylindrical portion 40. This interface may be assisted in sealing by providing a plurality of circumferential serrations or by adhesive attachment or by any other conventional sealing technique.

Located above the stationary member's cylindrical portion 42, is a bulkhead 43. A reservoir 44 is formed by an upward cylindrical extension 45 of the bulkhead 43, within which a separate lower portion 46 is fitted in sealing relationship to the inside diameter of said cylindrical extension 45.

At its uppermost part as seen in FIG. 3, the stationary member 36 is provided with a finned or otherwise relieved inlet 47 leading to an outwardly tapering conical upper valve seat 48. The reservoir has an inwardly tapering lower valve seat 49 formed in the lower portion 46 and which portion terminates in a finned or otherwise relieved outlet 50.

The dispensing valve assembly 27 has a hollow float 51, which may be bell-shaped and whose purpose is to trap air below the toilet tank water level and thus provide upward bouyancy loading in a first position of the movable member 38, to one end of which the float 51 is fixed. The uppermost central portion of the float 51 may contain a cylindrical inner surface 52 whose purpose is to accept a lowermost first cylindrical portion 53 of movable member 38 in a tight-fitting, leaktight relationship and effect a mechanical lock between these members so that they will move as one. The cylindrical inner surface 52 may possess a vent hole 55 to relieve air from this interface during assembly.

Immediately above the float 51, said movable member's first cylindrical portion 53 passes through the stationary member outlet 50, the movable member or stem being guided in vertical motion by fins 56 of the stationary member. Above the outlet 50, the stem 38 is provided with an outwardly tapering conical lower plug or valve head 57 which complements said inwardly tapering lower seat portion 49 of the stationary member and engages said seat in a sealing relationship to form a closed valve when buoyancy is withdrawn from the float 51 by emptying the tank 25. Above the lower plug 57, the stem 38 tapers inwardly to a second cylindrical portion 58, then to an inwardly tapering conical plug or valve head portion 59, which complements the outwardly tapering upper seat 48 of the stationary member 36 and engages said seat in a sealing relationship to form a closed valve when buoyant loading is present on the float 51 by the tank being filled with water. The size of said upper plug 59 is significantly smaller in diameter than that of the lower plug 57. At the innermost part of the upper plug taper 59, the stem is provided with a third cylindrical portion 60 which passes through the stationary member inlet 47, the stem being guided in vertical motion by fins 61 of the stationary member. The third cylindrical portion 60 is significantly smaller than the first cylindrical portion 53 and the flowpath cross-section through the inlet 47 is significantly smaller than the flowpath cross-section through the outlet 50 with the stem 38 installed.

That volume located within the stationary member 36 and between it and the moving member 38, as bounded by the seats 48, 49, constitutes the fluid reservoir 44, said volume being essentially the amount of concentrate to be delivered to the tank water on each flush cycle.

With the stem 38 in its normal first position with toilet tank water at or near its highest level, trapped air within the float 51 provides sufficient buoyant loading on the stem 38 to effect a sealing relationship between the upper plug 59 and the upper seat 48 and to prevent bottle liquid leakage across this interface. When the toilet is flushed, characteristically, the water drops very rapidly. Thus, buoyant loading on the float is lost rapidly and the stem drops to its second position rapidly to form a seal between the seat 49 and plug 57, minimizing liquid interflow, said interflow occurring when neither plug is on its seat. Bottle liquid then flows through the inlet 47 and fills the reservoir 44, said filling being assisted by the streamlined configuration of said reservoir, the displaced air within the reservoir flowing upward through the inlet 47 and into the bottle. In this second position, the combination of moving member weight and bottle fluid head pressure reacting on the area sealed by the lower plug 57 produce a sufficient downward load on the plug to form a leaktight seal against the seat 49.

As water slowly rises in the tank and passes the level of the skirted bottom 62 of the float 51, air is trapped within the float 51, providing a bouyant upward loading on the float 51 and the stem 38, which increases slowly as toilet tank water level slowly rises. When the bouyant upward load equals the downward load, the larger lower plug 57 will crack away from its seat 49, initiating flow from the reservoir 44 through the outlet hole 50 into the tank water. Instantly, bottle liquid will attempt to refill the reservoir 44 via the inlet 47. But the inlet flowpath cross-section is significantly smaller than the outlet flowpath cross-section. Thus, at that instantaneous moment where the stem 38 is not sealing on either seat, liquid drains from the reservoir 44 faster than it can be replaced from the bottle. This flow differential results in an instantaneous reduction in fluid head pressure within the reservoir acting downwardly on the plug 57. As reservoir pressure reacting on the lower plug 57 is a significant portion of the total downward load imposed on the stem, an instantaneous reduction in reservoir pressure greatly reduces this downward load, allowing the upward buoyant loading to now "pop" the upper plug 59 to the upper seat 48 and seal. As a result, while it is characteristic of most flush toilets that their water level rises slowly, my invention provides a valving "pop" action in transit from its tank empty to its tank full positions, thus minimizing interflow and assuring that the amount of liquid dispensed is essentially the same as that of the reservoir volume. Further, it may be seen that said "pop" action makes the volume of liquid dispensed completely independent of liquid level or fluid pressure head in the bottle, the volume dispensed remaining constant whether the bottle is full or nearly empty.

The reservoir 44 contents flow by gravity through the outlet 50 to the outwardly tapering upper portion 63 of the float 51, then to the tank water, trapped tank air within the stationary member cylindrical portion 42 replacing the reservoir liquid. Complete emptying of the reservoir is aided by the streamlined internal shape of the stationary member lower portion 46.

In this embodiment, bottle liquid leakage during shipment through the dispensing valve is prevented by the cap 15 which, upon being threaded to the bottleneck 35, first engages a skirted bottom 62 of the float 51, forcing said float 51 and the stem 38 to firmly seat the upper plug 59 against the stationary member's upper seat 48. The wall thickness of the skirt 62 and the tapered top 63 of said float are made very thin so as to be sufficiently flexible to deform elastically as the cap 15 continues to be threaded to the bottle until the cap seals against the stationary member flange 37. However, the float 51 is made sufficiently rigid so as to impress sufficient sealing load on the upper plug 59 to seal against the stationary member's upper seat 48, regardless of bottle attitude, be it upright, upsidedown or in any other position.

Figure 4:
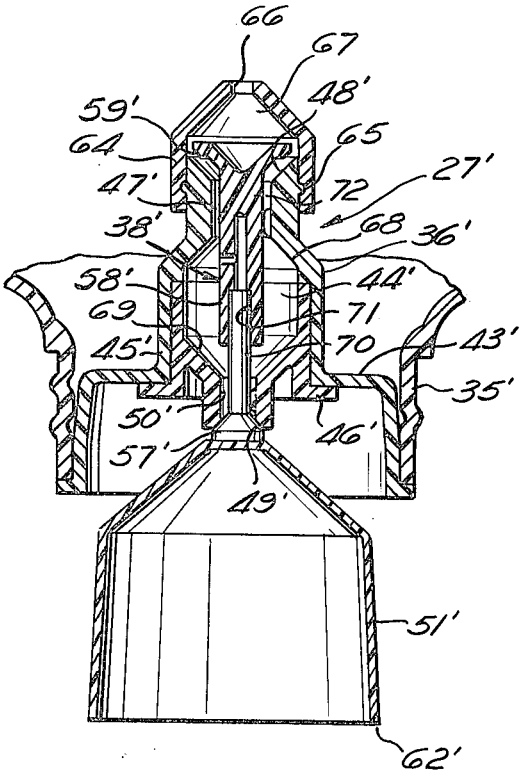
FIG. 4 is a sectional view of an alternate embodiment of dispenser.

FIG. 4 depicts a second embodiment of dispensing device 27' in cross-section. This configuration will also limit interflow by providing a "pop" action to the valve in its upward transit.

A stationary member 36' of this embodiment is much the same as that of the first embodiment regarding its fitting and sealing within a lower bottleneck 35'. It also possesses a supporting bulkhead 43' leading inwardly to a hollow reservoir portion 44', the upper portion of the said reservoir being formed by an upward cylindrical extension 45' of the said bulkhead. The lower portion of the reservoir is also formed by a separate tightly-fitting and sealing lower seat portion 46'.

However, the stationary member 36' of this embodiment possesses a second upward extension 64 which may be snap-fitted or otherwise mechanically retained to the top of the first cylindrical extension 45' by, for example, snapping over an annular lobe portion 65 of the first extension 45'. This second cylindrical extension 64 tapers upwardly and inwardly to a fixed restriction inlet 66. Below said inlet 66, a hollow chamber 67 is formed, leading to an inwardly tapering conical upper seat 48', the innermost portion of which forms a finned or otherwise relieved reservoir inlet 47'. Immediately below the reservoir inlet 47', a reservoir 44' is formed by an outwardly tapering upper portion 68 and an inwardly tapering lower portion 69, said lower portion terminating in a finned or otherwise relieved outlet 50'. Below said outlet 50' is located an outwardly tapering lower seat portion 49'. The reservoir inlet 47' is significantly larger in cross-sectional area for fluid flow than the outlet 50' in this configuration.

A movable member or stem 38' has a hollow float 51' which may be bell-shaped and with the same purpose as in the first embodiment. However, the uppermost central portion of this float is provided with an inwardly tapering lower plug 57' whose purpose is to engage the stationary member's lower seat 49' in sealing relationship in a first or tank full position of the stem 38'. The lower plug 57' terminates in a first cylindrical portion 70 which passes through the finned outlet 50', said cylindrical portion 70 being guided in vertical or longitudinal motion by said fins. The cylindrical portion 70 is then tightly fitted or otherwise mechanically retained within a central bore 71 of a second cylindrical portion 58' of the movable member 38'. The function of this interface is to mechanically lock the stem 38' to the float so that they move as one. The stem 58' has a second cylindrical portion 72 which passes through the reservoir inlet 47' and is guided in vertical motion by said fins. Said second cylindrical portion then tapers outwardly to form a conical upper plug portion 59', which functions to engage the upper seat 48' of the stationary member 36' in sealing relationship in a second or tank empty position of the stem 38'. The upper plug 59' is significantly larger in diameter than the lower plug 57' and the flowpath cross-section through the reservoir inlet 47' is significantly larger than the flowpath cross-section through the inlet 66 or through the outlet 49'.

In a normal first position of the dispenser shown by FIG. 4, bottle liquid passes through the inlet 66, fills the chamber 67 and, passing through the reservoir inlet 47' fills the reservoir 44', flow to tank water being blocked by the lower plug 57' seating against lower seat 49'. Sufficient seat load to seal this valve is provided by the upward buoyant effect of trapped air within the float 51'. Air within the reservoir 44' and the chamber 67 is displaced by the entering bottle liquid and flows upstream to the bottle, said flow being assisted by the streamlined shape of these cavities.

In flushing, the toilet tank water drops rapidly thereby removing the float's buoyant upward loading on the movable member 38' and is followed by the stem 38' dropping rapidly due to the weight of the moving member and bottle fluid head pressure reacting on the valve plugs 57', 59'. The stem 38' reaches its second position and downward motion is terminated when its upper plug 59' seats on the upper seat 48'. Reservoir liquid then flows to the tank water through the outlet 50'. In this second position, moving member weight and bottle fluid head pressure acting on the area sealed by the larger upper plug 59' combine to produce sufficient downward load on the upper plug 59' to seal it against the upper seat 48'.

As water slowly rises in the tank and passes the level of the skirted bottom 62', air is trapped within the float 51', again providing a bouyant upward loading on the float 51' and the movable member 38', said bouyant loading increasingly slowly as tank water level slowly rises. When the buoyant upward load equals the downward load on the closed upper plug 59', the plug will crack away from the upper seat 48', initiating liquid flow from the chamber 67 to the reservoir 44'. Bottle liquid will attempt to refill the chamber 67 via the restricted inlet 66 but, as the restricted flowpath cross-section is significantly smaller than the reservoir inlet 47' flowpath cross-section, liquid drains from the chamber 67 faster than it can be refilled through the resticted inlet 66. This causes an instantaneous reduction in fluid head pressure within the chamber 66 and so on the plug 59'. As chamber pressure reacting on the upper plug 59' is a significant portion of the downward loading on the movable member 38', the instantaneous reduction in the chamber pressure instantaneously reduces the downward loading on the plug 59', allowing the upward bouyant load on the stem 38' to "pop" the smaller lower plug 57' upward to its seat 49' and seal. As with the first embodiment, this "pop" action reduces interflow and maintains the volume of liquid dispensed to essentially that of the reservoir 44', said volume dispensed being independent of fluid level in the bottle.

Thus, it is seen that my invention contemplates a specially-designed bottle, which contains a sliding clip that engages a protruding slot on the bottle and is used to firmly attach and hold the bottle to the top of a flush toilet tank and to minimize bottle motion during flush cycles. The bottle is provided with two threaded caps which may be dimensionally identical. The cap located at that end of the bottle opposite to the clip is threaded to the bottle and contains and engages both the stationary and moving members of the dispensing valve in such a manner as to prevent leakage. The other cap at or near the clip end of the bottle is threaded to the bottle and engages an ultrasonically sealed positive foil seal, stopper or other removable seal so as to prevent leakage at this interface. The top of this latter cap may also serve to act with the bottom of the bottle in maintaining the bottle stable and upright on the shelf.

The dispensing device consists of a stationary member which engages its bottleneck in a sealing relationship and, contains, successively, an inlet, an upper valve, a fluid reservoir, a lower valve and an outlet. The moving member is a two-plug stem and float combination, whose plugs are oppositely disposed relative to one another on the stem so as to alternately seal against respective seats formed on the stationary member. Thus, the stem, at a point below the inlet contains a conical plug or head which engages and seals against the upper valve seat of the stationary member in a first position of the movable member. At a point above the stationary member's outlet, the stem possesses a second conical plug or head which engages the lower seat of the stationary member in a sealing relationship in a second position of the movable member. With the upper cap and its seal removed, aerosol ingredients which may comprise a portion of the bottle fluid concentrate are allowed access to toilet tank air through the open bottleneck formerly closed by the cap and seal.

On a flush cycle, the water in the tank drops, drawing air in around the tank lid to fill that void previously occupied by water. This entering air picks up and mixes with the bottle's aerosol ingredients and, on the subsequent water refill of the toilet tank, the aerosol-laden air is forced out of the tank by the rising water, automatically air freshening the bathroom.

The float traps air in its bell-shaped inside portion during filling of the tank. This provides the float with sufficient buoyancy to close and seal one of the plugs against its seat on the stationary member when the tank is full. When this buoyant effect is removed, as in flushing, fluid head pressure reacting on the plugs and the weight of the movable member cause it to move downward and seat and seal the other plug on the other seat in a second position of the movable member.

When the tank water rises and the float incremently increases its upward load on the stem due to buoyancy, a point will be reached where bottle fluid head pressure reacting on the closed plug will be overcome by the bouyant effect on the stem from the rising water, and the closed plug will crack away from its seat and start to discharge fluid. In so doing, instantaneous pressure above the just opened plug will significantly and instantaneously decrease. This pressure decrease has the effect of causing the movable member to "pop" to its first position.

By use of a relatively large opening at the top of the bottle which is recessed below the top of the toilet tank, it is an easy matter to determine when the bottle requires refilling by looking into the opening. It is also a simple matter to refill the bottle, in-place in the toilet tank without inadvertent spilling, or to add one's favorite scent to the bottle's concentrate.

Illustrated in FIGS. 1–4 are two specific embodiments of the invention. Many obvious variations may be made with respect to these two embodiments which still remain within the spirit and scope of the invention. For example, the valves shown are of the type utilizing matched conical head and seat interfaces. Obviously, other types of valves may be used, such as flat, chamfered, spherical or conical seating surfaces. A sharp seating edge can be used. Thus, in its broadest aspects, the individual valves of the present invention may be of any type providing a head and seat arrangement or the equivalent thereof.

Similarly, the stem guidance fins in each embodiment are shown as extending inwardly into the bottle fluid passage from the fixed member. The guidance fins may also extend outwardly from the movable member, either entirely or in combination with inwardly extending guidance fins.

While only a foil seal 31 and supporting bulkhead 32 have been described, other means for normally sealing the refill bottleneck 29 can be used. For example, a removable stopper can be substituted. The refill bottleneck 29 itself may be varied as to its location. While shown as offset and having a cap that assists in providing shelf standing capability, the bottleneck 29 can be located elsewhere and the standing capability provided by the bottle bottom in a modified configuration so as to be flat over the major bottom surface of the bottle. For example, the bottleneck could be centrally located and recessed in a flat-bottomed bottle, or even offset from the bottom, so long as the opening formed by the bottleneck is effectively above the water level of the toilet tank when installed.

I claim:

1. Apparatus for dispensing liquid in a measured amount into water contained in a toilet tank upon toilet flushing comprising:

a bottle having a first opening at one end thereof and a second opening at the other end thereof;

selectively removable closing means normally closing each opening prior to installation of said bottle in said tank so as to hold liquid in the bottle;

means for mounting said bottle within the tank so that the bottle normally is partially submerged in the tank water with the first opening normally submerged and the second opening above the tank water level;

a valve assembly disposed in said first opening and fixed to said bottle, said valve assembly having (a) a first member which is fixed to the first opening so as to extend within the bottle, said fixed member having (i) an inlet disposed within the bottle to provide a passage for the liquid contained in the bottle into a reservoir formed in the fixed member, said reservoir being below the inlet when the bottle is mounted in the tank and (ii) an outlet formed in the fixed member so as to be below the reservoir when the bottle is mounted in the tank, said inlet, reservoir and outlet being generally axially aligned with one another to provide a passage for the bottle liquid through the fixed member; and (b) a second member which is movable and is disposed within the fixed member bottle liquid passage;

first valve means formed by said fixed member and said movable member between the reservoir and inlet, said first valve means having a first valve seat formed in the fixed member and a first valve head formed on the movable member so as to seal the bottle liquid passage when seated on the first valve seat;

second valve means formed by said fixed member and said movable member in said bottle liquid passage downstream from the reservoir, said second valve means having a second valve seat formed in the fixed member and a second valve head formed on the movable member and disposed thereon so as to seal the bottle liquid passage when seated on the second valve seat; and in which the first valve means is comprised of a valve seat facing upstream and a valve head facing downstream in the bottle liquid passage and the second valve means is comprised of a valve seat facing downstream and a valve head facing upstream in the bottle liquid passage;

said first and second valve heads being connected together by a valve stem portion of the movable member which extends through the reservoir and being disposed on said stem so as to face in opposite directions relative to one another;

a float mounted on the movable member so as to be disposed external of the fixed member outlet and operable, when the bottle is mounted in the tank so as to be partially submerged and the closing means are removed from the first and second openings, to raise and lower the valve stem portion in response to filling and emptying, respectively, of the tank so that, when said tank is full of water, one of said valve means closes and seals the bottle liquid passage and when the tank is empty, the other said valve means closes and seals the bottle liquid passage;

and in which the inlet has a minimum cross-sectional area open to bottle liquid flow which is less than the minimum cross-sectional area open to bottle liquid flow within the fixed member downstream from the one of said valve means which is closed when the tank is empty whereby, when said closed valve means opens in response to upward movement of float during tank filling, the downward fluid pressure on the valve head thereof rapidly decreases, so that, in response to the upward pressure of the float, the valve stem portion moves upwardly at a much greater rate than the rate of water level rise in the tank, thereby rapidly closing the other of said valve means.

2. Apparatus according to claim 1, and in which the valve seats are separated from the reservoir by portions of the bottle liquid passage.

3. Apparatus according to claim 2, and in which the fixed member inlet is formed by a restricted cap portion which encloses the first valve head and has an aperture to provide communication between the bottle liquid passage and the bottle interior, said first valve head being of substantially greater diameter than the second valve head and the aperture.

4. Apparatus according to claim 2, and in which the fixed member forms a chamber within the opening and in communication with the outlet, said chamber being operable, during tank filling, to trap tank air therein as the water level rises above the first opening.

5. Apparatus according to claims 2, 3 or 4, and in which the second valve head seals the bottle liquid passage at the outlet and is fixed to the stem portion at the float.

6. Apparatus for dispensing liquid in a measured amount into water contained in a toilet tank upon toilet flushing comprising:

a bottle having a first opening at one end thereof and a second opening at the other end thereof;

selectively removable closing means normally closing each opening prior to installation of said bottle in said tank so as to hold liquid in the bottle;

means for mounting said bottle within the tank so that the bottle normally is partially submerged in the tank water with the first opening normally submerged and the second opening above the tank water level;

a valve assembly disposed in said first opening and fixed to said bottle, said valve assembly having (a) a first member which is fixed to the first opening so as to extend within the bottle, said fixed member having (i) an inlet disposed within the bottle to provide a passage for the liquid contained in the bottle into a reservoir formed in the fixed member, said reservoir being below the inlet when the bottle is mounted in the tank and (ii) an outlet formed in the fixed member so as to be below the reservoir when the bottle is mounted in the tank, said inlet, reservoir and outlet being generally axially aligned with one another to provide a passage for the bottle liquid through the fixed member; and (b) a second member which is movable and is disposed within the fixed member bottle liquid passage;

first valve means formed by said fixed member and said movable member between the reservoir and inlet, said first valve means having a first valve seat formed in the fixed member and a first valve head formed on the movable member so as to seal the bottle liquid passage when seated on the first valve seat;

second valve means formed by said fixed member and said movable member in said bottle liquid passage downstream from the reservoir, said second valve means having a second valve seat formed in the fixed member and a second valve head formed on the movable member and disposed thereon so as to seal the bottle liquid passage when seated on the second valve seat;

said first and second valve heads being connected together by a valve stem portion of the movable member which extends through the reservoir and disposed on said stem so as to face in opposite directions relative to one another;

a float mounted on the movable member so as to be disposed external of the fixed member outlet and operable, when the bottle is mounted in the tank so as to be partially submerged and the closing means are removed from the first and second openings, to raise and lower the valve stem portion in response to filling and emptying, respectively, of the tank so that, when said tank is full of water, one of said valve means closes and seals the bottle liquid passage and when the tank is empty, the other of said valve means closes and seals the bottle liquid passage; and in which (a) the inlet has a minimum cross-sectional area open to bottle liquid flow which is less than the minimum cross-sectional area open to bottle liquid flow within the fixed member downstream from the one of said valve means which is closed when the tank is empty whereby, when said closed valve means opens in response to upward movement of float during tank filling, the downward fluid pressure on the valve head thereof rapidly decreases, so that, in response to the upward pressure of the float, the valve stem portion moves upwardly at a much greater rate than the rate of water level rise in the tank, thereby rapidly closing the other of said valve means;

(b) the bottle has a top in which the first opening is formed and a bottom which has a recessed portion in which the second opening is formed and second opening closing means extends downwardly from said second opening so as to terminate in a surface which is generally flush with the bottom; and (c) the means for mounting the bottle within the tank comprises a slotted ear formed on the bottle parallel to the sides of the bottle adjacent the bottom and a rectangular spring clip disposed in said slot so as to be normal to the ear, said clip having an L-shaped hanger extending from the top of one end thereof and a pair of opposed locking lugs depending from the bottom corners thereof so as to open into each other, said hanger and lugs lying in the same plane as the clip, said locking lugs being selectively lockable to the slotted ear so that one of said lugs holds the hanger in a retracted position between the bottle sides and the other of said lugs holds the hanger in an extended position beyond one of the bottle sides for engaging the tank.

7. Apparatus according to claim 6, and in which the fixed member forms a chamber within the opening and in communication with the outlet, said chamber being operable, during tank filling, to trap tank air therein as the water level rises above the first opening.

* * * * *